United States Patent [19]

Myles

[11] 4,120,641

[45] Oct. 17, 1978

[54] CERAMIC FIBER MODULE ATTACHMENT SYSTEM

[75] Inventor: Thomas Aquinas Myles, Tonawanda, N.Y.

[73] Assignee: The Carborundum Company, Niagara Falls, N.Y.

[21] Appl. No.: 773,586

[22] Filed: Mar. 2, 1977

[51] Int. Cl.[2] ..... F27D 1/16

[52] U.S. Cl. ..... 432/3; 432/76; 432/250; 428/119; 264/30; 228/120; 228/140; 266/280; 52/506; 156/71; 156/279

[58] Field of Search ..... 432/250, 76, 3, 247, 432/248, 252; 428/281, 119; 110/1 A; 264/30; 228/120, 135, 140; 266/280-282; 156/71, 279; 52/506, 513, 511; 13/35

[56] References Cited

U.S. PATENT DOCUMENTS

| | | | |
|---|---|---|---|
| 1,950,420 | 3/1934 | Stitt | 52/513 |
| 2,669,757 | 2/1954 | Lenk, Jr. | 52/506 |
| 3,832,815 | 9/1974 | Balaz et al. | 52/506 |
| 3,892,396 | 7/1975 | Monaghan | 110/1 A |
| 3,909,907 | 10/1975 | Davis | 110/1 A |
| 3,940,244 | 2/1976 | Sander et al. | 432/247 |
| 3,942,239 | 3/1976 | Johansson | 228/140 |
| 3,952,395 | 4/1976 | Crossman et al. | 228/135 |
| 3,990,203 | 11/1976 | Greaves | 110/1 A |
| 3,993,237 | 11/1976 | Sander et al. | 228/140 |

*Primary Examiner*—Henry C. Yuen
*Attorney, Agent, or Firm*—David E. Dougherty; Raymond W. Green

[57] ABSTRACT

A ceramic fiber module, suitable for lining furnaces, comprises a weldable (metallic or perforate refractory) backing and a number of ceramic fiber mats cemented to the backing by the edge of the mat, so as to leave a portion of the backing accessible between mats or on their perimeter, for welding. The weldable backing is welded to a metallic substrate, preferably by use of spherical attachments, to provide thermal protection to the metallic substrate.

19 Claims, 8 Drawing Figures

Fig. 7.
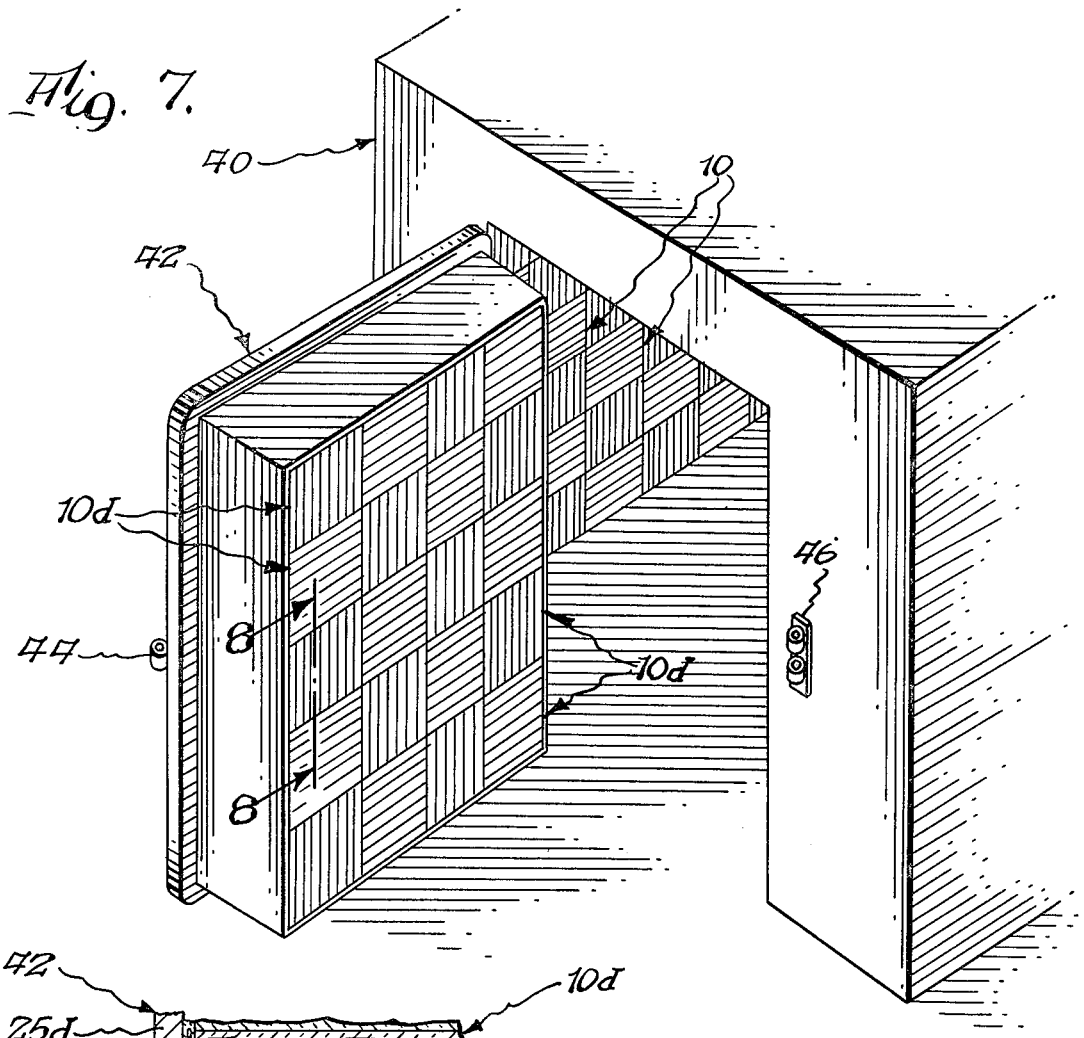
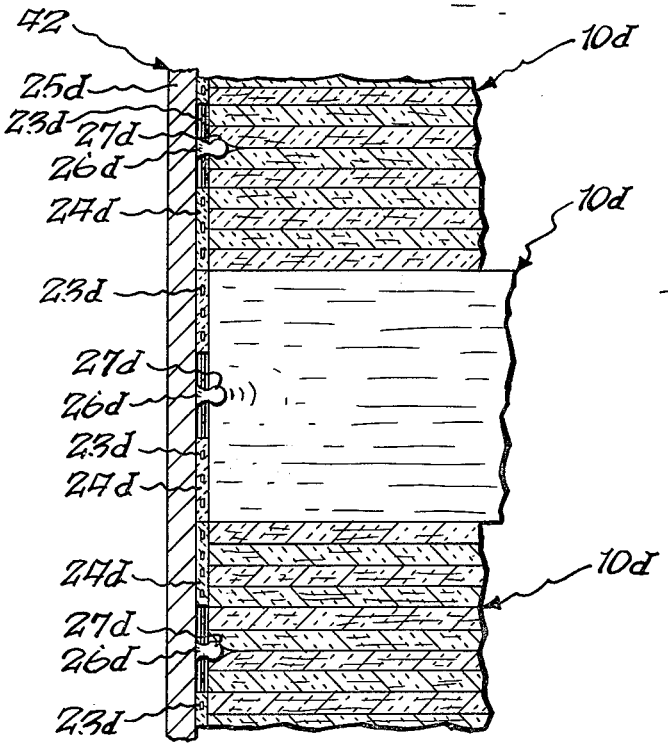
Fig. 8.

CERAMIC FIBER MODULE ATTACHMENT SYSTEM

BACKGROUND OF THE INVENTION

This invention relates to a ceramic fiber module attachment system. More particularly, it relates to a ceramic fiber module, a method of protecting metallic substrates from high temperature with such a module, and a furnace wall so protected.

A "furnace" as the word is used herein is any enclosed space maintained at a high temperature. An example of such a furnace would be a ceramic kiln within which ceramic articles are fired. Typically, furnaces may require temperatures of 1100° C., 1400° C., or even 1650° C. Particularly in today's fuel-short economy, it is necessary to provide methods of insulating such furnaces (i.e., of protecting the exterior walls from the temperature within the furnace), by insulating the walls. The term "walls" is used herein generically, including the ceiling, the floor and the movable closure portion of the furnace, usually designated as the "door". While floors are usually insulated with more complicated structures that must bear weight, modules are useful in some situations for floors. Furnace doors must be insulated, just like the stationary walls of the furnace, but because they are opened and closed frequently, the insulation on such movable walls, or doors, requires replacement much more frequently than the insulation upon the stationary walls.

It is, therefore, an object of the present invention to provide ceramic fiber modules for the insulation of furnace walls. A further object is to provide a method of protecting a metallic substrate from high temperature, and yet another object is to provide a furnace wall which is so protected.

Ceramic fiber modules for lining furnaces are known in the prior art, see for example Sauder et al U.S. Pat. No. 3,993,237 issued Nov. 23, 1976. It is, however, an object of the present invention to provide an improved module, method of attachment, and protected furnace wall.

SUMMARY OF THE INVENTION

There is, accordingly, provided a ceramic fiber module, comprising a weldable backing; a plurality of ceramic fiber mats, each mat being substantially perpendicular to the backing, and all of the mats of a module being substantially parallel to each other; adhesive, bonding at least a portion of one end of each ceramic fiber mat to the weldable backing, but leaving a portion of the backing accessible, e.g., between at least one pair of adjacent ceramic fiber mats or on the perimeter of the module; and metallic spherical means for welding the backing to a metallic substrate. There is further provided a method of protecting a metallic substrate from high temperature, comprising assembling a plurality of such modules; aligning the weldable backings of the modules adjacent to and parallel to the metallic substrate; and welding at least a portion of the backing of each module to the metallic substrate, by means of at least one spherical welding attachment.

There is further provided, according to the invention, a furnace wall, comprising a metallic substrate and a plurality of such modules, the weldable backing of each module being aligned adjacent to and parallel to the metallic substrate, at least a portion of each backing being welded to the metallic substrate.

BRIEF DESCRIPTION OF THE DRAWINGS

FIGS. 7 and 8 illustrate a furnace wall, including a furnace wall in the form of a movable closure for the furnace commonly known as a door, comprising modules according to the present invention.

DETAILED DESCRIPTION

Figure 1:
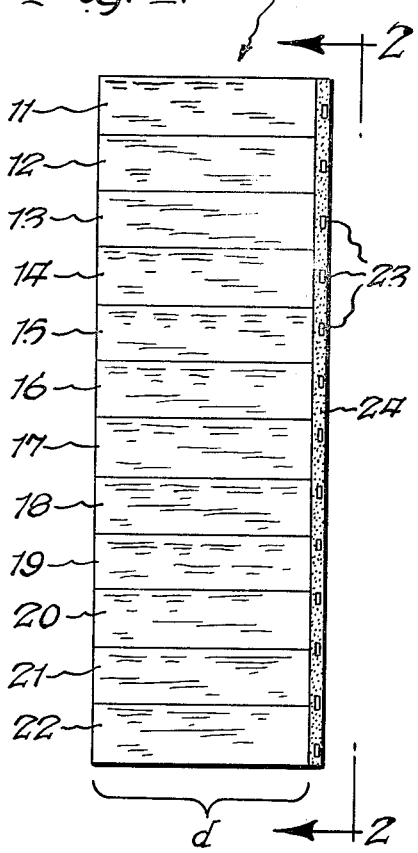
FIGS. 1 and 2 illustrate a typical module according to the invention.

The first element of the ceramic fiber module according to the present invention is a weldable backing. For most applications, it is preferred that this weldable backing be metallic, but in some cases, especially for furnaces containing a corrosive environment, it is desirable to avoid the use of metallic backings, since they are subject to attack by the corrosive environment within the furnace. In such a case, the weldable backing can be perforate refractory, and in particular perforate refractory with openings having the shape of a spherical segment. Such an opening has a shape which would be obtained by grinding the side of the backing which is to face inwardly toward the furnace with a spherical grinding apparatus, until a hole all the way through the refractory backing is drilled, having a diameter which is perhaps about the same as the radius of the sphere. There is thus provided an opening in the perforate refractory backing in which a sphere can be nestled, so as to protrude somewhat through the ceramic backing for welding to a metallic substrate.

In practice, of course, the openings would not be produced by grinding, but would be molded into the refractory backing when initially formed.

In the usual case, however, as noted, the backing is preferred to be metallic. It is further preferred, but not essential, that the backing be perforate, particularly with openings having the shape of a rhombus. A convenient and especially preferred backing is expanded metal.

Expanded metal is sheet metal cut and expanded into a lattice. It is commercially available, for example, from Metalex Corporation, of Libertyville, Ill., in a variety of materials, weights, and with minor modifications in design. All of the various modifications, however, contain a pattern of openings having the shape of a rhombus. The size of the rhombus opening in the expanded metal is chosen in conjunction with the size of spherical attachment to be described below, so that the spherical attachment has a diameter slightly larger than the rhombus-shaped opening.

The second element of the ceramic fiber module according to the present invention is a plurality of ceramic fiber mats. "Ceramic fiber mats" as used herein includes blankets, felts, papers, textiles and vacuum cast boards. The preferred mat for use in the ceramic fiber module of the present invention is the ceramic fiber blanket, in which each mat comprises ceramic fibers randomly oriented in substantially planar configuration. The composition of the ceramic fiber is basically alumina/silica, and the preferred fiber is available from The Carborundum Company of Niagara Falls, N.Y. as Fiberfrax ® ceramic fiber.

At least a portion of one end of each of the ceramic fiber mats is bonded to the weldable backing, leaving a portion of the backing accessible. This bonding is accomplished with adhesive, which is conventional in and of itself. For most applications it is preferred to use a refractory mortar such as Firefrax ® refractory mortar which is available from The Carborundum Company of Niagara Falls, N.Y. Such mortars are known in the trade as "Grade A refractory mortars". Such mortars are composed of alumina, silica, clay, sodium silicate and water. A suitable mortar, for example, contains 16.0 Kg raw 48 mesh alumina-silica grog (composition 3 $Al_2O_3 \cdot 2\ SiO_2$ + water of hydration); 2.7 Kg calcined 35 mesh alumina--silica grog; 4.0 Kg kaolin clay; 5.4 Kg sodium silicate; and 2.5 Kg water (thinned with water to suit). Other adhesives can be used if desired, however, particularly depending upon the temperature to which the adhesive is to be subjected. For example, if the temperature within a furnace in which the module of the present invention is used is to be maintained below about 200° C., which might be the case if a sufficiently cool "cold face" is desired, organic adhesives such as plastic cement or even wallpaper paste can be used, provided the adhesive is to be maintained at sufficiently low temperature as to avoid degradation.

The fourth element of the ceramic fiber module according to the present invention is the metallic spherical means for welding the backing to a metallic substrate. The metallic spherical means attaches the weldable backing to the metallic substrate (e.g., furnace shell lining), either between the ceramic fiber mats or on the perimeter of the backing around the ceramic fiber mats. Spherical welding means are commercially available, for example under the trademark "Ball-Stud" welding system of KSM Welding Systems Division of Omark Industries of Moorestown, N.J.

These various elements can be assembled in different ways, depending on preference and intended application. For example, with reference to FIG. 1, there is illustrated a module 10 comprising 12 mutually parallel ceramic fiber mats 11–22, of depth "*d*". Depth "*d*" can vary as desired, for example, 10, 15, or 30 centimeters depth. It is preferred that the ceramic fiber mats 11–22 have the configuration of a ceramic fiber blanket, for example approximately 2.5 centimeters in thickness, one preference being that the width be such as to provide a square module as illustrated in FIG. 2.

At least a portion of one end of each of the ceramic fiber mats 11–22 is bonded to weldable backing 23 by means of adhesive 24. This bonding must be done in a manner so as to leave a portion of the backing accessible for welding, for example, by leaving an exposed central portion without adhesive, as illustrated in FIG. 2. In the module illustrated in FIGS. 1 and 2, the area of the backing is substantially the same as the sum of the total areas of the ends of the ceramic fiber mats bonded to the backing, but is of course, larger than the sum of the bonded portions of the ends of the ceramic fiber mats. "Substantially the same" includes the preferred situation in which the expanded metal backing is about 25 cm by 30 cm, and in which there are employed 12 ceramic fiber mats, each comprising ceramic fibers randomly oriented in substantially planar configuration and having an end about 30 cm long and about 2.5 cm thick. By using an expanded metal backing which is slightly smaller than the total area of the ceramic fiber mts, the ceramic fiber mats can be slightly compressed in use so as to provide a close fit and better thermal insulation.

Figure 2:
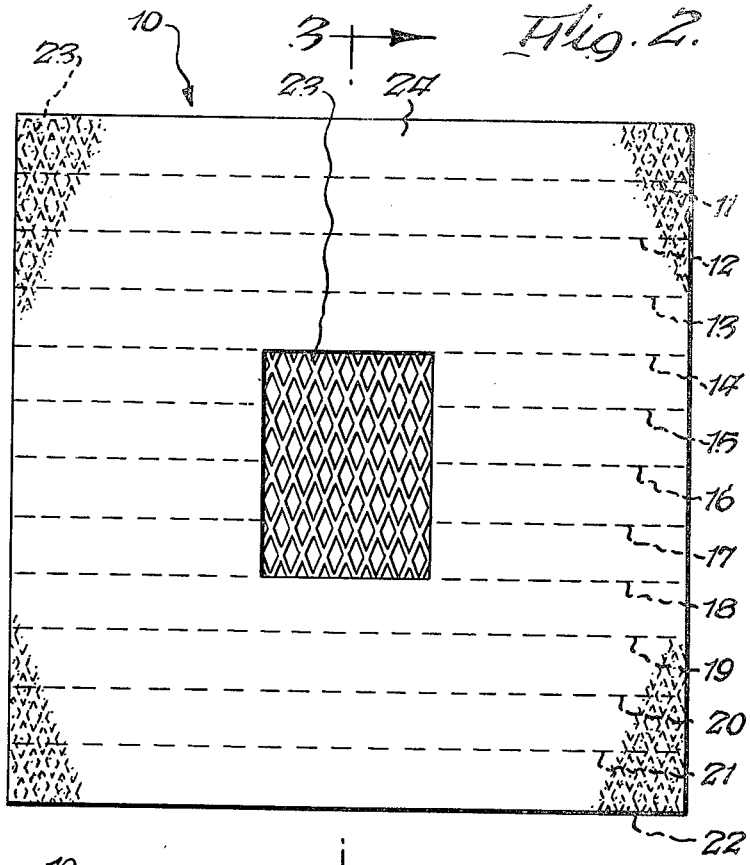

As shown in FIG. 2, a portion of the ceramic fiber mats 11–22 is bonded to the expanded metal backing 23 by refractory cement 24, leaving uncemented a central portion at least 5 cm wide in each direction. A larger uncemented portion is preferred, for example an area about 10 cm by 15 cm.

As illustrated in FIGS. 1 and 2, the ends of the ceramic fiber mats are aligned with the area of the backing, so that substantially all of the backing is covered by the ceramic fiber mats, including the uncemented central portion. In some applications, however,, the ceramic fiber mats can be partially offset from the area of the backing, so as to provide a partial exposed perimeter on one side of the module, for welding to a metallic substrate. Such an offset configuration is illustrated in FIGS. 5 and 6.

Figure 5:
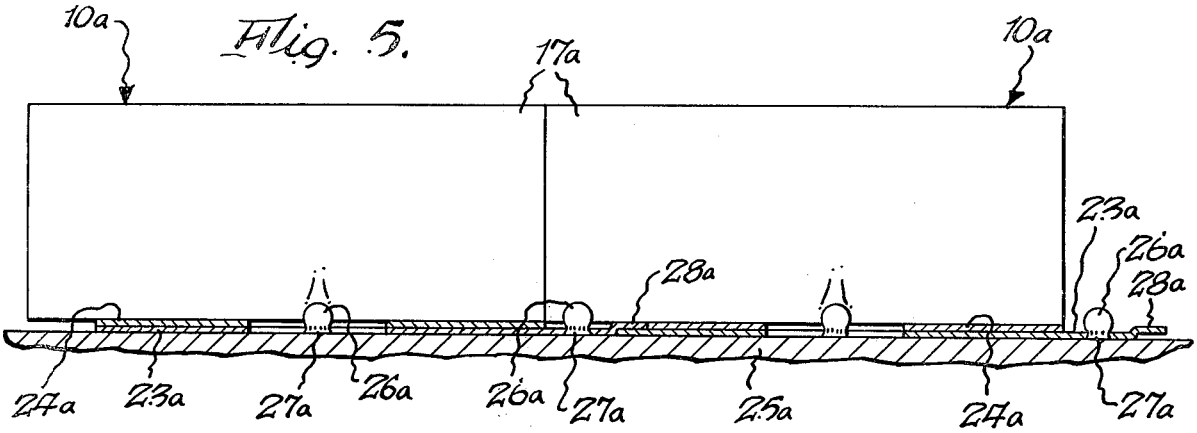
FIGS. 5 and 6 illustrate additional embodiments of modules according to the present invention.

According to another modification, the backing is partially recessed, as shown in FIG. 5 (see recessed portion **28*a***), in a direction toward the ceramic fiber mats, the unrecessed portion of the backing having an area substantially the same as the sum of the total areas of the ends of the ceramic fiber mats bonded to the backing. This allows positioning an unrecessed portion of the backing of substantially each module beneath the recessed portion of an adjacent module. The end members of each row of modules, of course, will not be so overlapped.

Figure 6:
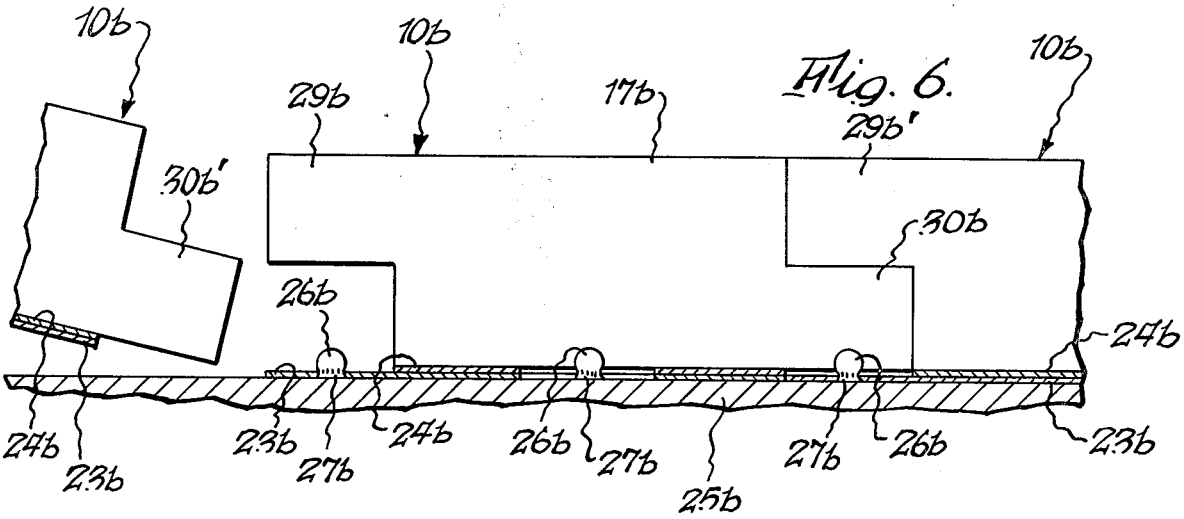

Another modification of the module of the present invention is shown in FIG. 6. According to this variation, a portion **29*b* of each mat opposite the backing is offset (to the left in FIG. 6) with respect to the portion of the mat 30*b* adjacent to the backing. This allows the offset portion of the mats of substantially each module to be positioned over the portion of the mats of an adjacent module which is not offset, as shown by the overlap of offset portion 29*b*' over portion 30*b*** of the adjacent module.

Figure 3:
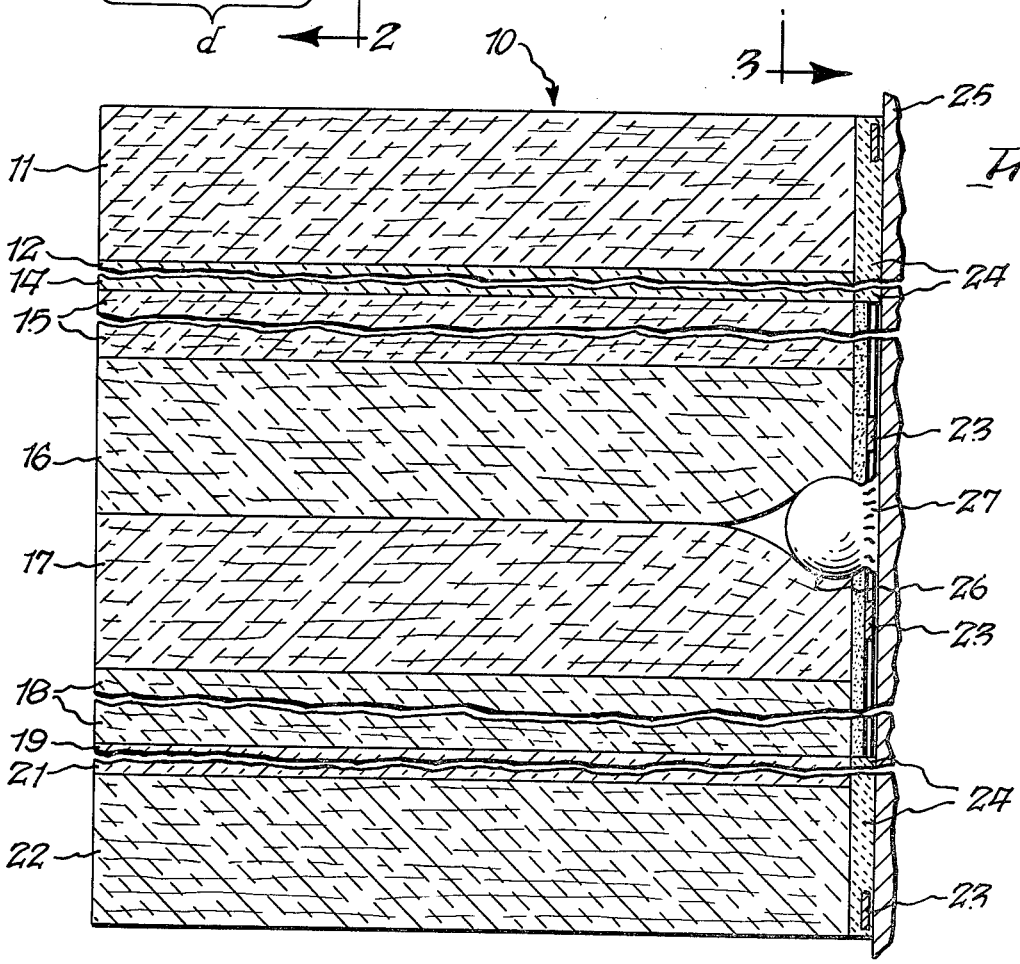
FIG. 3 illustrates the module, by view analogous to that of FIG. 1, but welded to a metallic substrate by means of a sphere.

FIG. 3 illustrates the welding of the module of FIGS. 1 and 2 to a metallic substrate 25. The central ceramic fiber mats 16–17 are separated, so as to provide access to the uncemented central portion of the weldable backing 23. Sphere 26 is then welded at weld 27 to metallic substrate 23 through an opening in the backing 23 (It is of course, possible to weld a non-perforated metallic backing to a metallic substrate, using the spherical welding attachment approach. In such a case, however, the weld will be of the sphere to the metallic backing and of the metallic backing to the metallic substrate.).

Figure 4:
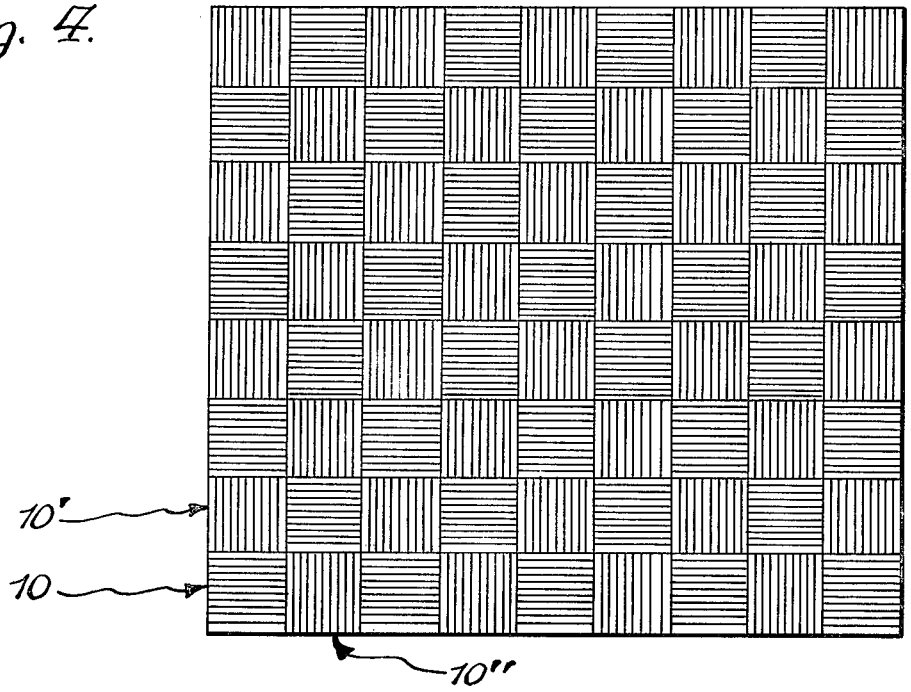
FIG. 4 illustrates a furnace wall, showing a preferred orientation of fiber mats of the individual modules.

In the event that the configuration illustrated in FIGS. 1–3 is adopted for the ceramic module, i.e., in which the area of the backing is substantially the same as the sum of the total areas of the ends of the ceramic fiber mats bonded to the backing and the ends of the ceramic fiber mats are aligned with the area of the backing, without offset portions as illustrated in FIG. 6, the orientation shown in FIG. 4 is preferred to the adjacent ceramic modules, i.e., wherein the modules are oriented with mats of adjacent modules 10, 10' and 10'' mutually perpendicular.

FIGS. 5 and 6 illustrate alternate module configurations and attachment configurations. FIG. 5 is a sectional view of alternate modules **10*a*, looking towards ceramic fiber mats 17*a*. As shown in FIG. 5, the backing 23*a* is bonded to the ceramic fiber mats by adhesive 24*a*, analogous to the module illustrated in FIGS. 1–3. With the module illustrated in FIG. 5, central bonding can still be accomplished, as with the module shown in FIGS. 1-3, but in addition (or alternately, if desired) welding can be accomplished at the perimeter of the module 10***a*, by welding at least one metallic spherical welding attachment through the exposed (left as illustrated) portion of the backing 23*a*. This has the advantage that the placement of the sphere 26 can be accomplished directly through an opening of the metallic backing 23, so as to insure a secure weld. In the case of central welding, between adjacent ceramic fiber mats, the welding is "blind", and placement of sphere 26*a* (or 26 in FIG. 3) is accomplished by feel. It is therefore sometimes desirable to weld more than one metallic spherical welding attachment 26 per module, in order to insure that the module is welded securely. With the placement of the metallic spherical welding attachment around the perimeter, however, the placement and adequacy of weld can be easily determined visually, prior to placing the next module.

The hidden edge of the module can be secured beneath the recess 28*a* of an adjacent module, thereby eliminating the need for "blind" central welding altogether, if this is the desire.

A further modification of the module is shown in FIG. 6. In the modules 10*b* of FIG. 6, a portion 29*b* of each mat opposite the backing 23*b* is offset with respect to the portion 30*b* adjacent the backing. This configuration is particularly useful when the pattern of FIG. 4 is not feasible. Because some ceramic fiber mats may tend to shrink upon being exposed to high temperature, overlapping the offset portions (for example 29*b* over 30*b*' and 29*b*' over 30*b*) reduces the possibility of exposure of the metallic substrate 25*b* between adjacent modules 10*b*, should sufficient shrinkage occur.

Another feature which can be used in conjunction with the present invention is the application of refractory coatings on the surface of modules 10, 10', 10'', 10*a* or 10*b* which are exposed to the high temperature, to increase their high temperature resistance capability. Refractory cement may also be applied between adjacent mats 11-22, to bond them together and prevent delamination, if desired.

FIGS. 7 and 8 illustrate a furnace wall, including a furnace wall in the form of a movable closure for the furnace commonly known as a door, comprising modules according to the present invention. Referring to FIG. 7, furnace 40 includes movable closure 42 which can be held closed by closure means 44, 46. Modules 10 are attached to the furnace wall as illustrated in FIG. 8, which is a sectional view taken along line 8—8 of FIG. 7.

In FIG. 8, the movable closure 42 is shown to comprise ceramic fiber mats 10*d* which are fastened to expanded metal backing 23*d* by means of refractory cement 24*d*, the expanded metal backing 23*d* being attached to metal substrate 25*d* by means of spheres 27*d* which are welded by welds 26*d* to the metallic substrate 25*d*.

I claim:

1. A ceramic fiber module, comprising:

(a) a weldable backing;

(b) a plurality of ceramic fiber mats, each mat being substantially perpendicular to the backing, and all of the mats of a module being substantially parallel to each other;

(c) adhesive, bonding at least a portion of one end of each ceramic fiber mat to the weldable backing, leaving a portion of the backing accessible; and (d) metallic spherical means for welding the backing to a metallic at the accessible position of the backing substrate.

2. A module according to claim 1, wherein the area of the backing is substantially the same as the sum of the total areas of the ends of the ceramic fiber mats bonded to the backing.

3. A module according to claim 2, wherein the ends of the ceramic fiber mats are aligned with the area of the backing.

4. A module according to claim 1, wherein the ends of the ceramic fiber mats are partially offset from the area of the backing.

5. A module according to claim 4, wherein the backing is partially recessed, in a direction toward the ceramic fiber mats, the unrecessed portion of the backing having an area substantially the same as the sum of the total areas of the ends of the ceramic fiber mats bonded to the backing.

6. A method of protecting a metallic substrate from high temperature, comprising (a) assembling a plurality of modules according to claim 5, (b) aligning the weldable backings of the modules adjacent to and parallel to the metallic substrate, an unrecessed portion of the backing of substantially each module being positioned beneath the recessed portion of an adjacent module, and (c) welding at least a portion of the weldable backing of each module to the metallic substrate, by means of at least one metallic spherical welding attachment.

7. A module according to claim 1, wherein the weldable backing is perforate refractory.

8. A module according to claim 7, wherein the backing is perforate with openings having the shape of a spherical segment.

9. A module according to claim 1, wherein the backing is metallic.

10. A module according to claim 9, wherein the metallic backing is perforate.

11. A module according to claim 10, wherein the metallic backing is perforate with openings having the shape of a rhombus.

12. A module according to claim 11, wherein the metallic backing is expanded metal.

13. A module according to claim 12, consisting essentially of:

(a) an expanded metal backing about 25 cm × 30 cm;

(b) twelve ceramic fiber mats, each comprising ceramic fibers randomly oriented in substantially planar configuration and having an end about 30 cm long and about 2.5 cm thick;

(c) refractory cement bonding the end of each ceramic fiber mat to the expanded metal backing, but leaving uncemented a central portion at least 5 cm wide in each direction; and (d) at least one metallic spherical welding attachment.

14. A module according to claim 1, wherein a portion of each mat opposite the backing is offset with respect to the portion of the mat adjacent to the backing.

15. A method of protecting a metallic substrate from high temperature, comprising (a) assembling a plurality of modules according to claim 14, (b) aligning the weldable backings of the modules adjacent to and parallel to the metallic substrate, the offset portion of the mats of substantially each module being positioned over the portion of the mats of an adjacent module which is not offset, and (c) welding at least a portion of the weldable backing of each module to the metallic substrate, by means of at least one metallic spherical welding attachment.

16. A method of protecting a metallic substrate from high temperature, comprising (a) assembling a plurality of modules according to claim 1, (b) aligning the weldable backings of the modules adjacent to and parallel to the metallic substrate, and (c) welding at least a portion of the weldable backing of each module to the metallic substrate, by means of at least one metallic spherical welding attachment.

17. A method according to claim 16, wherein the modules are oriented with mats of adjacent modules mutually perpendicular.

18. A furnace wall, comprising (a) a metallic substrate, and (b) a plurality of modules according to claim 1, the weldable backing of each module being aligned adjacent to and parallel to the metallic substrate, at least a portion of each backing being welded to the metallic substrate.

19. A wall according to claim 18, in the form of a movable closure for the furnace.

* * * * *